US006742768B2

(12) United States Patent
Alba

(10) Patent No.: US 6,742,768 B2
(45) Date of Patent: Jun. 1, 2004

(54) SCISSOR LIFTING TABLE

(75) Inventor: Adelardo Lopez Alba, Papiol (ES)

(73) Assignee: Transportes Continuos Interiores, S.A., Papiol (ES)

( * ) Notice: Subject to any disclaimer, the term of this patent is extended or adjusted under 35 U.S.C. 154(b) by 0 days.

(21) Appl. No.: 10/379,646

(22) Filed: Mar. 5, 2003

(65) Prior Publication Data

US 2003/0168646 A1 Sep. 11, 2003

(30) Foreign Application Priority Data

Mar. 7, 2002 (ES) ..... 200200550
Dec. 23, 2002 (ES) ..... 200202977

(51) Int. Cl.[7] ..... B66F 3/22

(52) U.S. Cl. ..... 254/122; 254/124; 254/164; 187/211

(58) Field of Search ..... 254/122, 124, 254/126, 9 R, 9 B, 7 R, 7 B; 182/141, 63, 69; 187/211, 18, 8.5, 8.71, 8.72

(56) References Cited

U.S. PATENT DOCUMENTS 4,405,116 A * 9/1983 Eisenberg ..... 254/122
4,749,169 A * 6/1988 Pickles ..... 254/122
4,867,277 A * 9/1989 Sloan ..... 187/243
4,941,797 A * 7/1990 Smillie, III ..... 414/462
5,262,706 A * 11/1993 Hollingsworth ..... 318/560
5,339,749 A * 8/1994 Hirose ..... 108/143
5,379,855 A * 1/1995 Juang ..... 187/269
6,299,138 B1 * 10/2001 Huang et al. ..... 254/126
6,516,478 B2 * 2/2003 Cook et al. ..... 5/611

FOREIGN PATENT DOCUMENTS

EP 0 724 540 B1 3/1997
ES 9202601 6/1993

* cited by examiner

*Primary Examiner*—Joseph J. Hail, III
*Assistant Examiner*—Daniel Shanley
(74) *Attorney, Agent, or Firm*—Michael J. Strike

(57) ABSTRACT

This table comprises scissor arms (1, 2) assembled on a common rotation axis (3) and two thrust shafts (6, 7) shifting by the action of drive means and acting on the opposite sides of the scissor arms (1, 2), causing the tabletop (5) to lift or lower. The drive means comprise:

a geared motor (8) providing a rotational movement to a first thrust shaft (6);

an anti-rotation support (9) preventing the geared motor (8) from rotating around said first thrust shaft (6), and belts (10) fixed to the anti-rotation support (9) by one of their ends and to the periphery of the first thrust shaft (6) by the opposite end, wrapping around the second thrust shaft (7) with their intermediate area.

8 Claims, 4 Drawing Sheets

SCISSOR LIFTING TABLE

SUMMARY OF THE INVENTION

The present invention refers to a scissor lifting table, of the type comprising scissor arms assembled with rotational possibility around a common rotation axis, and which are fixed to a base and to the tabletop by one of their ends, with flattening possibility, and to the tabletop and to the table base, respectively, by the other end, with shifting possibility; furthermore incorporating two thrust shafts, parallel to the common rotation axis, which shift horizontally in opposite directions by the action of drive means and act on the opposite sides of the scissor arms, causing the scissor to open or close and the tabletop to lift or lower.

Lifting tables with a scissor-type lifting system are currently widely known, in which actuation means act on the scissor arms, causing the relative rotation thereof around a common rotation axis and, subsequently, the lifting or lowering of the tabletop supported on the scissor mechanism.

Normally, the actuation means in these lifting tables include one or more screws which are responsible for acting on the scissor arms, causing the table to lift or lower.

Thus, for example, Utility Model 9202601 discloses a scissor lifting table provided with a lifting device having a pair of rollers running on the oblique surfaces of a carriage shifted by the action of a threaded screw supported on the floor frame and which meshes with a thread of said carriage.

Likewise, Spanish patent ES 2 102 258, originating from European patent EP 0 724 540, discloses a lifting table with a scissor-type lifting system in which a motor acts by means of a threaded screw on several swivel-mounted connecting rods in turn acting on the scissor arms, causing the table to lift or lower.

In the registered background mentioned, screws are used in order to achieve the actuation of the scissor, the use of screws in this type of lifting tables being a significant drawback since they require high maintenance, with the subsequent costs.

In scissor-type lifting tables actuated by means of screws, the means responsible for acting on the scissor arms may have different shapes and arrangements, in some cases being connecting rods or an oblique carriage, as in said background, or by two horizontal thrust shafts parallel to the common rotation axis of the scissor arms, and which act by means of the corresponding bearings on the opposite sides of said arms, such that upon approaching or distancing the thrust shafts, they cause the table to lift or they permit it to lower by its own weight.

DESCRIPTION OF THE INVENTION

The scissor lifting table object of the present invention is of those comprising: a lower base or platform and an upper tabletop connected by means of a scissor mechanism, several scissor arms assembled with rotational possibility around a common rotation axis, and two thrust shafts parallel to the rotation axis and which horizontally shift in opposite directions due to the action of drive means, acting on the opposite sides of the scissor arms in order to cause the tabletop to lift or lower.

The table of the invention has several constructive particularities focused on: eliminating the use of threaded screws for the purpose of significantly reducing repair and maintenance tasks of the lifting table, improving the working conditions of the thrust shafts such that they are subjected to a smaller bending moment, permitting the automatic breakage detection of the shaft thrust means, for the purpose of immediately replacing them and preventing the lifting table from working in unsuitable conditions.

According to the invention, the drive means used for lifting and lowering the scissor lifting table object of the invention comprise:

- a geared motor assembled on a first thrust shaft of the scissor arms and which provides said first thrust shaft with a rotational movement;
- an anti-rotation support preventing the geared motor from rotating around the first thrust shaft, and
- belts fixed by one of their ends to the anti-rotation support, and fixed by the opposite end to the periphery of the first thrust shaft, said belts wrapping around the second thrust shaft with their intermediate area.

As the first thrust shaft rotates due to the action of the geared motor, the belts are wound and unwound around said first thrust shaft, and the relative approaching or distancing of said first and second thrust shafts is achieved, subsequently lifting or lowering the tabletop.

The actuation of the thrust shafts by means of the belts permits eliminating the screws conventionally used for this purpose, with this reducing maintenance and repair costs, as previously mentioned.

In order to simplify the transmission of movement from the geared motor to the first thrust shaft, it has been foreseen that said geared motor is provided with a hollow output shaft in which the first thrust shaft is assembled; the geared motor transmitting the rotational movement directly to said first thrust shaft.

The anti-rotation support comprises a vertical plate extending towards the second thrust shaft and having a longitudinal slit for its shiftable support on a support wheel assembled on the central area of the second thrust shaft, which prevents the geared motor from being able to rotate around the first thrust shaft.

The central arrangement of the anti-rotation support and the support thereof by means of said swivel on the support wheel provided on the second thrust shaft ensures that the relative shifting between said anti-rotation support and the second thrust shaft is carried out smoothly and with minimum friction.

The anti-rotation support has a transversal swingbar for fixing one of the ends of the belts and breakage detection means for either of the belts, said means being actuated by said transversal swingbar.

According to the invention, the belts are arranged to the sides of the anti-rotation support of the geared motor and in correspondence with the opposite ends of the first and second thrust shaft, such that said belts act on areas of the thrust shafts that are very close to the actuation areas of said thrust shafts against the scissor arms of the lifting table, achieving a significant reduction of the bending moment to which said thrust shafts are subjected.

The transversal swingbar is arranged in a significantly horizontal position and parallel to the thrust shafts, said swingbar being assembled on the anti-rotation support of the geared motor by means of a ball joint. This ball joint allows the swingbar to swing on a significantly horizontal plane.

The transversal swingbar has respective tension devices on its ends for fixing one of the ends of the respective belts and regulating the tension of said belts. The swingbar tends to arrange itself in that position in which the belts fixed to its ends work with the same tension.

The breakage detection means for the belts comprise a detector actuated by the transversal swingbar when the latter tilts towards one of the sides due to the breakage of the belt fixed on the opposite side of said swingbar.

Said detector can be mechanical, optic, magnetic, electric or of any other type, since it implies no substantial variation of the invention.

DESCRIPTION OF THE PREFERRED EMBODIMENT

Figure 1:
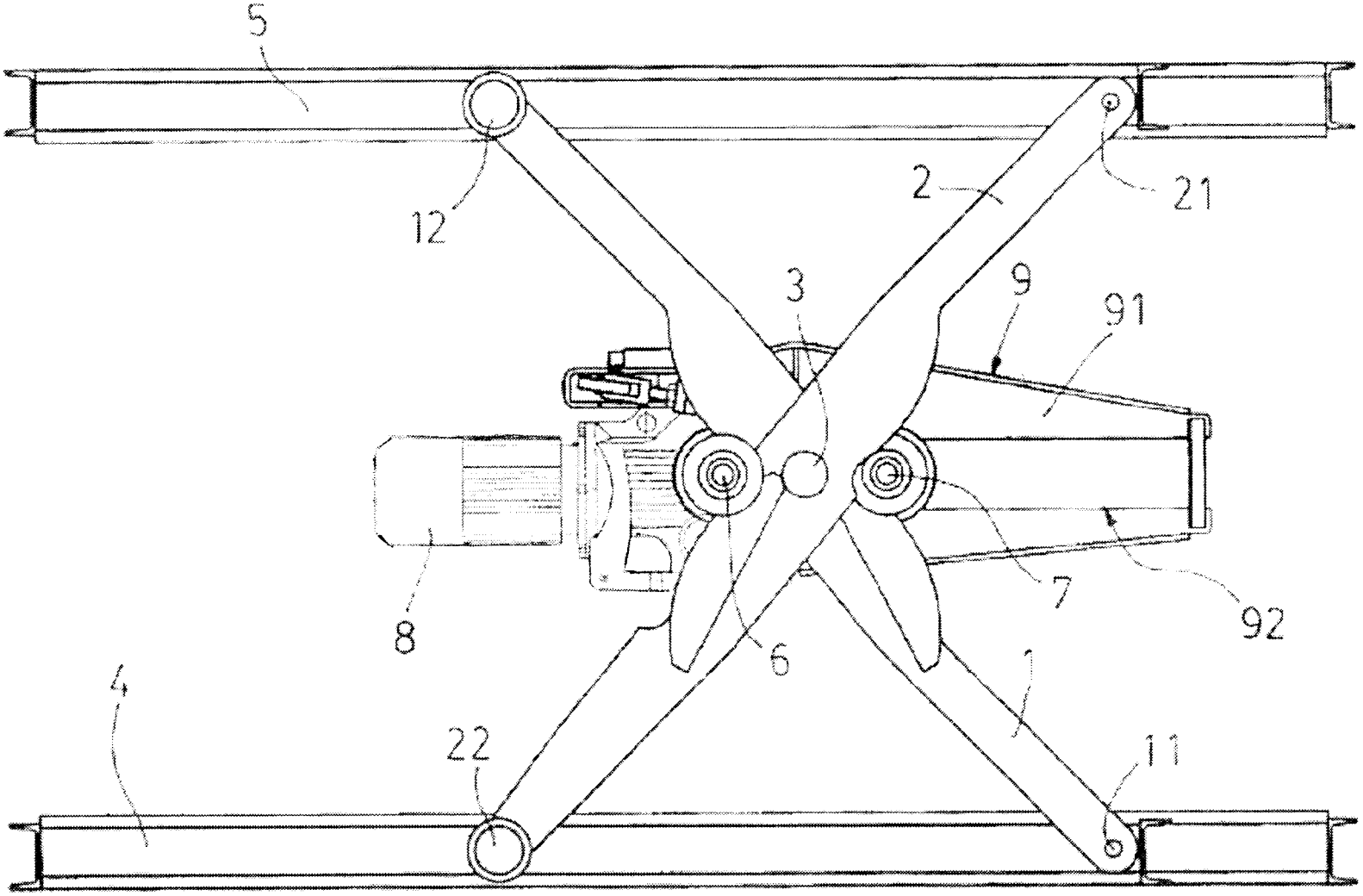
FIG. 1 shows an elevational view of the scissor lifting table with the tabletop in the upper position.
Figure 2:
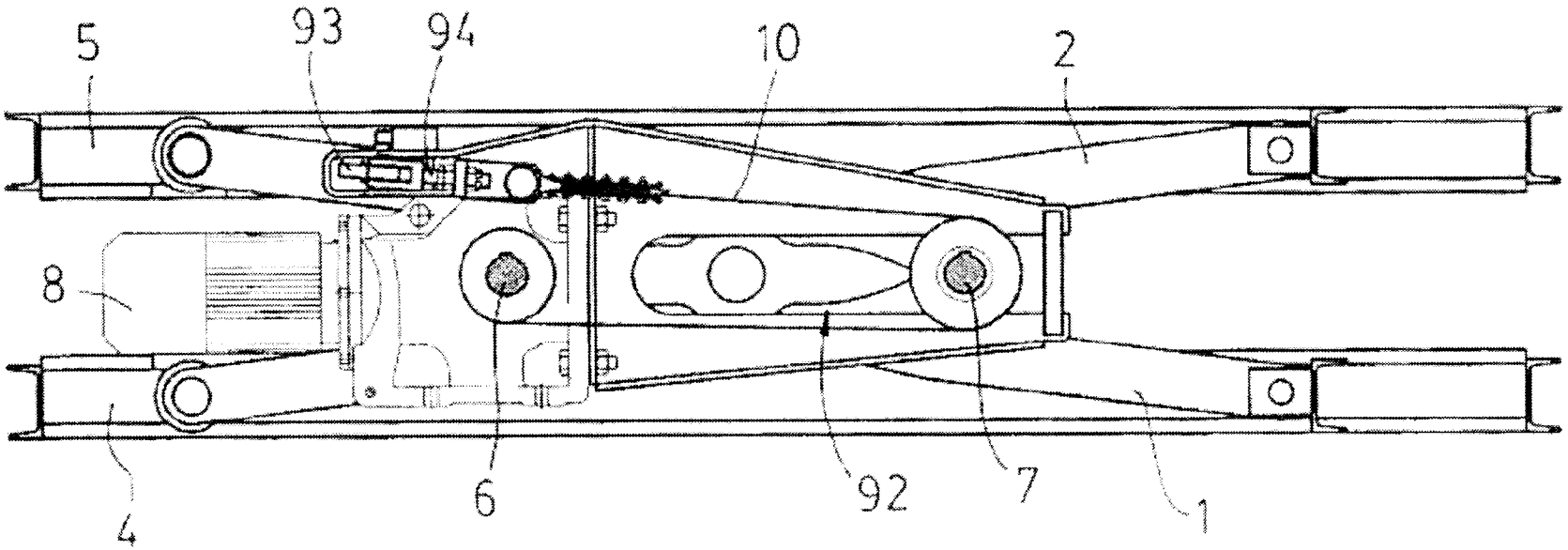
FIG. 2 shows an elevational view of the lifting table of the previous figure, with the tabletop in the lower position and sectioned by a vertical plane.
Figure 3:
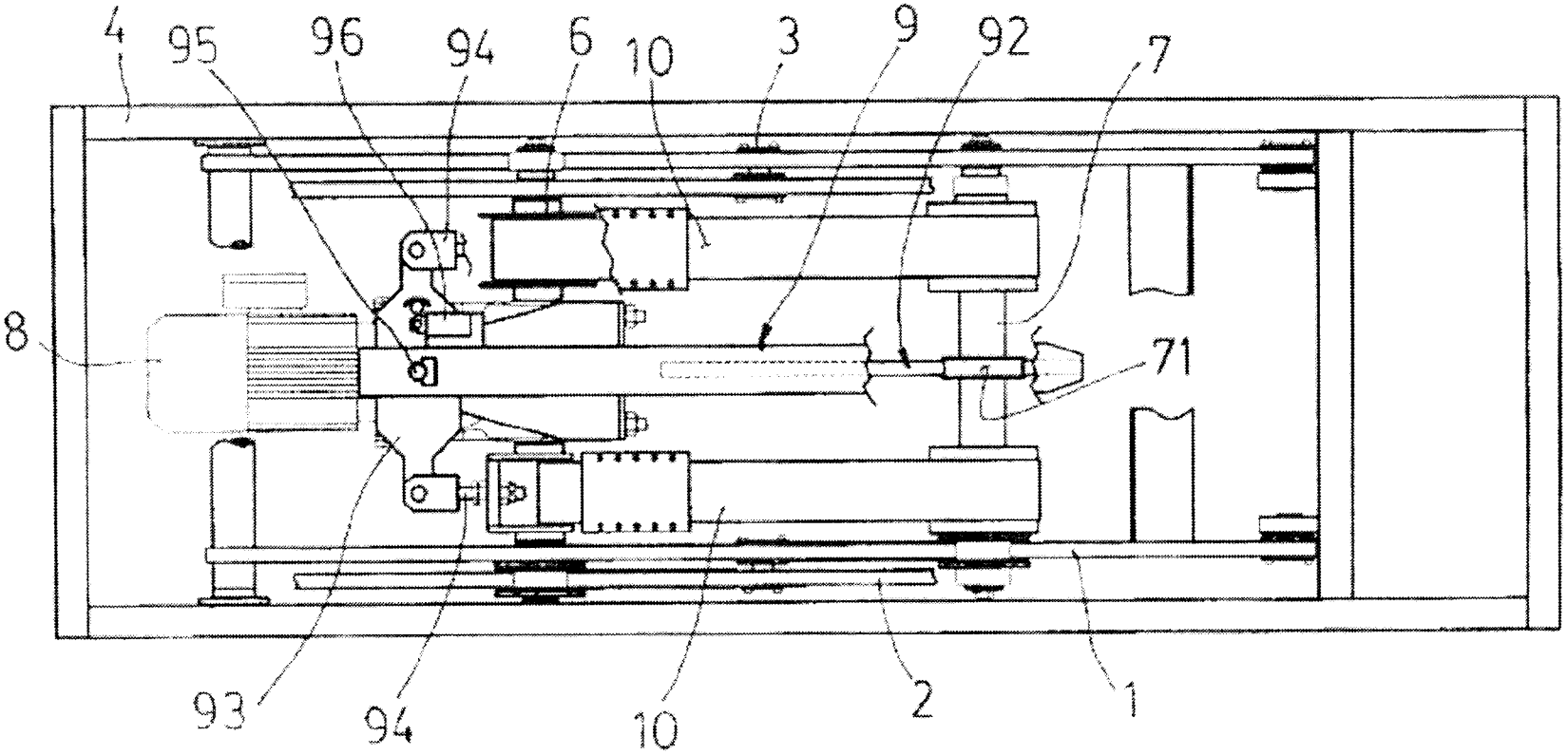
FIG. 3 shows an upper plan view of the scissor lifting table in which an upper area thereof has been removed, the anti-rotation support of the geared motor having been partially sectioned, and in which an end portion of one of the belts intended to be fixed on the transversal swingbar has also been removed.
Figure 4:
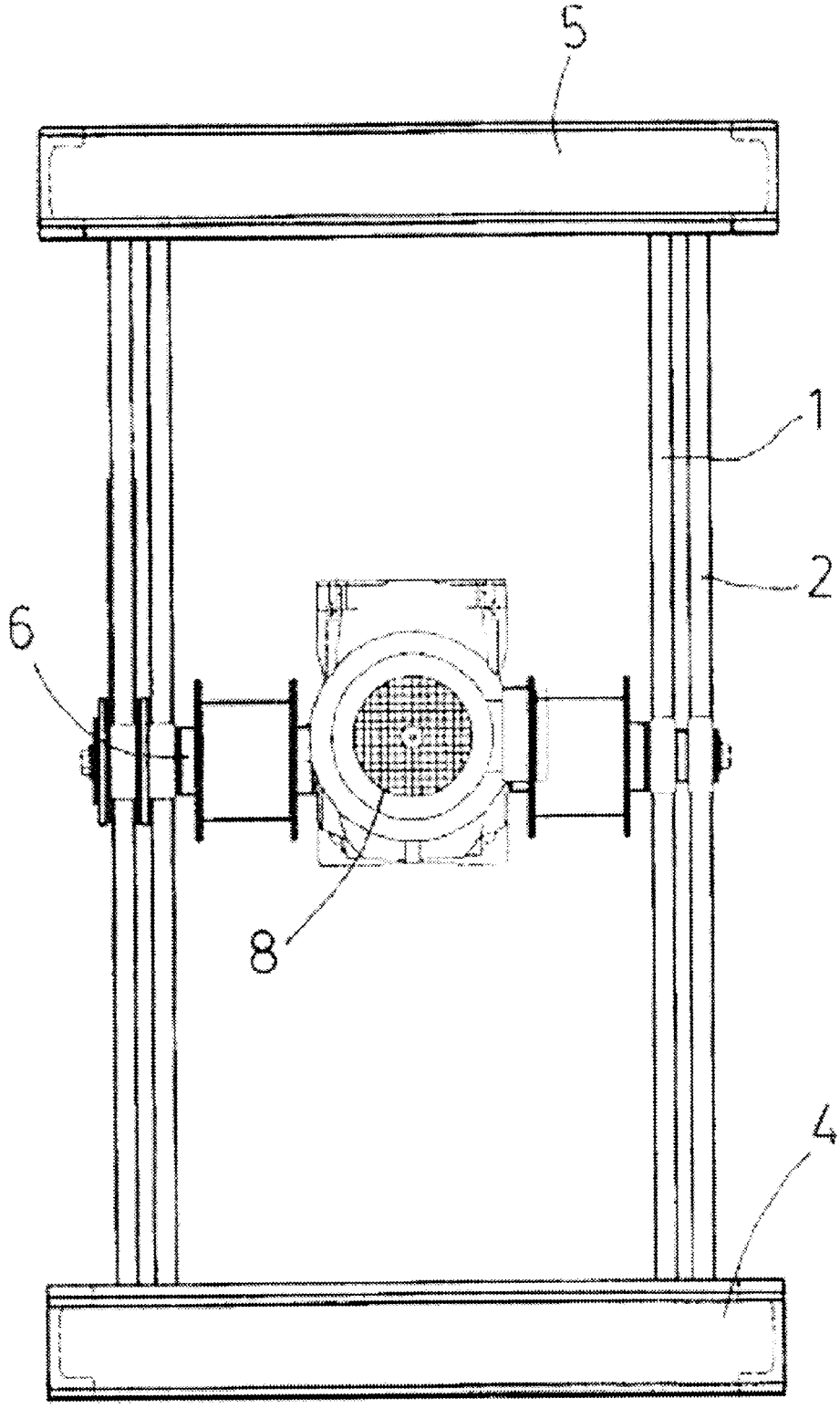
FIG. 4 shows a schematic profile view of a scissor lifting table and which only shows: the lower base or platform, the scissor arms, the geared motor, and the first thrust shaft.

The scissor lifting table shown in the figures comprises scissor arms (1 and 2) assembled on a common rotation axis (3). One of the ends of the scissor arms (1 and 2) is assembled with flattening possibility and by means of respective rotation axes (11 and 21) to the base (4) and to the tabletop (5), respectively. The scissor arms (1 and 2) have rolling means (12 and 22) on the opposite ends permitting them to shift along the tabletop (5) and the base (4), respectively, during lifting and lowering of the tabletop (5).

A first and second thrust shafts (6 and 7), parallel to the common rotation axis (3) of the scissor arms (1 and 2), act on opposite sides of the scissor arms (1 and 2).

A geared motor (8) is assembled on thrust shaft (6), providing the thrust shaft (6) with a rotational movement, in either direction, in order to lift or lower the tabletop (5).

The geared motor (8) has a hollow output shaft directly transmitting the rotational movement from the geared motor (8) to the first thrust shaft (6).

The lifting table has been provided with an anti-rotation support (9) in order to prevent the geared motor (8) from rotating around the shaft (6).

The anti-rotation support (9) is joined to the geared motor (8) and comprises a vertical plate (91) extending towards the second thrust shaft (7); said vertical plate (91) having a longitudinal slit (92) for its shiftable support on a support wheel (71) assembled on the central area of the second thrust shaft (7).

The anti-rotation support (9) is provided with a transversal swingbar (93) arranged in a significantly horizontal position and parallel to the thrust shafts (6, 7), said transversal swingbar (93) being fixed by means of a ball joint (95) on the end of the anti-rotation support corresponding to the first thrust shaft (6).

The approach and distancing of the first and second thrust shaft (6, 7) is determined by belts (10) arranged to the sides of the vertical plate (91) and fixed to the first thrust shaft (6) by one of their ends and to the ends of the swingbar (93) by the opposite end by means of the corresponding tension devices (94), such that the belts (10) wrap around the second thrust shaft (7) with their intermediate area.

The rotation of the geared motor (8) in both directions determines the winding and unwinding of one of the ends of the belts (10) around the first thrust shaft, subsequently, the approach and distancing of the first and second thrust shaft (6, 7), and the lifting and lowering of the tabletop (5).

The assembly of the swingbar (93) by means of the ball joint (95) on the anti-rotation support (9) permits said swingbar (93) to tend to arrange itself in a position in which the tension of the two side belts (10) is equalized.

A detector (96) is assembled on the anti-rotation support (9), composed of a microswitch, for example, actuated by the transversal swingbar (93) when the swingbar (93) laterally tilts due to the breakage of one of the belts (10) fixed to the ends of said transversal swingbar (93), the actuation of the detector (96) producing a signal indicative of the breakage of one of the belts (10).

Having sufficiently described the nature of the invention as well as a preferred embodiment example, it is stated to that end that the materials, shape, size and arrangement of the described elements can be modified, as long as this implies no alteration of the essential features of the invention, which are claimed below.

What is claimed is:

1. A scissor lifting table, of the type comprising scissor arms (1, 2) assembled rotatably on a common rotation axis (3), and which are fixed to a base or platform (4) and to the tabletop (5) by one of ends of the scissor arms, and fixed to the tabletop (5) and to the base or platform (4), respectively, by the other end, with shifting possibility; furthermore incorporating two thrust shafts (6, 7) parallel to the rotational axis (3), horizontally shifting in opposing directions due to the action of drive means and acting on the opposite sides of the scissor arms (1, 2), causing the tabletop (5) to lift or lower; characterized in that the drive means comprise:

a geared motor (8) assembled on a first thrust shaft (6) of the scissor arms (1, 2), and which provides a rotational movement to said first thrust shaft (6);

an anti-rotation support (9) preventing the geared motor (8) from rotating around the first thrust shaft (6), and belts (10) fixed to the anti-rotation support (9) by one end and to a periphery of the first thrust shaft (6) by an opposite end, said belts (10) wrapping around the second thrust shaft (7) with an intermediate area, such that, as the first thrust shaft (6) rotates, the winding and unwinding of the belts around said first thrust shaft (6), and the relative approach or distancing of said first and second thrust shaft (6, 7) are achieved, subsequently lifting or lowering the tabletop (5).

2. A lifting table according to claim 1, characterized in that the geared motor (8) has a hollow output shaft in which the first thrust shaft (6) is assembled non rotatably; the geared motor (8) transmitting the rotational movement directly to said first thrust shaft (6).

3. A lifting table according to claim 1, characterized in that the anti-rotation support (9) is assembled rotatably on the middle area of the first thrust shaft (6) and comprises a vertical plate (91) extending towards the second thrust shaft (7) and having a longitudinal slit (92); the end of the anti-rotation support (9) corresponding to the first thrust shaft (6) having a transversal swingbar (93) for fixing the ends of the belts (10) and having breakage detection means for either of the belts (10); said means being actuated by said transversal swingbar (93).

4. A lifting table according to claim 3, characterized in that the belts (10) are arranged to the sides of the vertical plate (91) of the anti-rotation support (9) and in correspondence with the opposite ends of the first and second thrust shaft (6, 7).

5. A lifting table according to claim 3, characterized in that the transversal swingbar (93) is arranged in a significantly horizontal position and parallel to the thrust shafts (6, 7).

6. A lifting table according to claim 3, characterized in that the transversal swingbar (93) is assembled to the anti-rotation support (9) by means of a ball joint (95) permitting the transversal swingbar (93) to swing in a significantly horizontal plane.

7. A lifting table according to claim 3, characterized in that the transversal swingbar (93) has respective tension devices (94) on its ends for fixing one of the ends of the respective belts (10) and regulating the tension of said belts (10).

8. A lifting table according to claim 3, characterized in that the breakage detection means for either of the belts (10) are composed of a detector (96) which is actuated by the transversal swingbar (93) when the swingbar (93) tilts towards one of the sides due to a breakage of the belt (10) fixed on the opposite end of said transversal swingbar (93).

* * * * *